US006176952B1

(12) United States Patent
Maugans et al.

(10) Patent No.: US 6,176,952 B1
(45) Date of Patent: Jan. 23, 2001

(54) METHOD OF MAKING A BREATHABLE, MELTBLOWN NONWOVEN

(75) Inventors: Rexford A. Maugans, Lake Jackson, TX (US); Thomas T. Allgeuer, Wollerau (CH); Jill M. Martin, Pearland, TX (US)

(73) Assignee: The Dow Chemical Company, Midland, MI (US)

( * ) Notice: Under 35 U.S.C. 154(b), the term of this patent shall be extended for 0 days.

(21) Appl. No.: 09/302,644

(22) Filed: May 3, 1999

Related U.S. Application Data

(60) Provisional application No. 60/083,784, filed on May 1, 1998.

(51) Int. Cl.[7] ..... B32B 31/00

(52) U.S. Cl. ..... 156/73.1; 156/290

(58) Field of Search ..... 156/73.1, 242, 156/290, 553, 555, 580.1, 580.2; 264/442, 443, 444; 442/400

(56) References Cited

U.S. PATENT DOCUMENTS

| | | | | |
|---|---|---|---|---|
| 5,616,408 | | 4/1997 | Oleszczak et al. | 442/346 |
| 5,879,494 | * | 3/1999 | Hoff et al. | 156/73.3 |
| 5,989,370 | * | 11/1999 | Wannebo | 156/73.1 |
| 6,099,670 | * | 8/2000 | Kouks et al. | 156/73.1 |

FOREIGN PATENT DOCUMENTS

| | | | |
|---|---|---|---|
| 0 483 859 A1 | 5/1992 | (EP) | D06M/10/02 |
| 674 035 A2 | 9/1995 | (EP) | D04H/1/56 |
| 96/38620 A1 | 12/1996 | (WO) | D04H/13/00 |
| 97/30202 | 8/1997 | (WO) | D04H/13/00 |

OTHER PUBLICATIONS

International Search Report dated May 3, 1999 issued by the EPO acting as the International Searching Autority in PCT/US99/09522.

* cited by examiner

*Primary Examiner*—James Sells

(57) ABSTRACT

The present invention relates to a method of making a breathable nonwoven fabric having enhanced moisture barrier properties. In particular, the invention pertains to a method of making a meltblown fibrous layer having an improved hydrohead performance (e.g. greater than 40 millibars (16 inches of $H_2O$) and adjacent to at least one spunbond fibrous layer, wherein the method comprises secondary processing of the meltblown layer prior to bonding to spunbond layers. The resultant spunbond/meltblown (SM) nowoven fabric is breathable and characterized as having a cloth-like feel and softness and enhanced hydrohead performance rendering it suitable for use in, for example, personal hygiene, disposable industrial garment and infection control/clean room applications for items such as coverings, incontinence pads and diapers, especially as a diaper backsheet or containment flap.

17 Claims, 1 Drawing Sheet

METHOD OF MAKING A BREATHABLE, MELTBLOWN NONWOVEN

CROSS REFERENCE TO RELATED APPLICATIONS

This application is a continuation-in-part application of U.S. provisional application no. 60/083,784, filed May 1, 1998, now abandoned, the disclosure of which is incorporated herein, in its entirety, by reference.

FIELD OF THE INVENTION

The present invention relates to a method of making a breathable nonwoven fabric having enhanced moisture barrier properties. In particular, the invention pertains to a method of making a meltblown fibrous layer having an improved hydrohead performance (e.g. greater than 40 millibars (16 inches of $H_2O$) and adjacent to at least one spunbond fibrous layer, wherein the method comprises secondary processing of the meltblown layer prior to bonding to spunbond layers. The resultant spunbond/meltblown (SM) nowoven fabric is breathable and characterized as having a cloth-like feel and softness and enhanced hydrohead performance rendering it suitable for use in, for example, the personal hygiene and medical markets for items such as infection control garments and coverings, incontinence pads and diapers, especially as a diaper backsheet or containment flap.

BACKGROUND OF THE INVENTION

Nonwoven fabrics used in disposal garments, diapers, incontinence pads and other personal hygiene items are required to possess a number of important end-use attributes. Key performance attributes include breathability, cloth-like feel and softness, drapeability and conformability as well as act as a barrier against the penetration of liquids. Clothlike feel and softness and conformability relate to wearer comfort and both attributes tend to correlate to the suppleness of the nonwoven fabric. However, breathability and barrier properties are inversely related since breathability relates to the comfort of the wearer by facilitating respiration. That is, good breathability refers to the passage o moisture vapor. Alternately, good barrier properties relate to the impermeability of liquids and bodily fluids such as blood in the case of surgical gowns and urine in the case of disposable diapers.

Known nonwoven fabrics and laminate structures represent a substantial performance compromise between breathability and barrier properties. That is, the art is replete with nonwoven fabrics that possess good breathability but low barrier performance and vice-versa. The art is also replete with various fiber making methods including meltblowing and spunbonding techniques as well as SMS structures. See, for example, U.S. Pat. No. 3,338,992 to Kinney; U.S. Pat. No. 3,502,538 to Levy; U.S. Pat. No. 3,502,763 to Hartman; U.S. Pat. No. 3,849,241 to Buntin; U.S. Pat. No. 4,041,203 to Brock et al.; U.S. Pat. No. 4,340,563 to Appel et al.; U.S. Pat. No. 4,374,888 to Bomslaeger; and U.S. Pat. No. 5,169,706 to Collier et al., the disclosures of all of which are incorporated herein by reference.

WO 97/34037, the disclosure of which is incorporated herein by reference, describes a laminate having at least one layer of meltblown elastic fibers bonded on either side with a layer of soft nonelastic fibers of greater than 7 microns in average diameter. All of the inventive examples in WO 97/34037 which consist of elastic meltblown layers exhibit a hydrohead performance less than or equal to 14.3 mbars. The exemplified control SMS structure in WO 97/34037 which consist of side-by-side polypropylene polyethylene spunbond layers and a nonelastic polypropylene layer exhibit a hydrohead performance of 21.3 mbars.

U.S. Pat. No. 5,607,798, the disclosure of which is incorporated herein by reference, describes a laminate which can be in the form of a SMS structure and comprises a polymer blend of a high crystalline polypropylene and a random block copolymer of polypropylene and polyethylene. The object of the invention described in U.S. Pat. No. 5,607,798 is said to be to provide a nonwoven fabric with improved strength properties. However, U.S. Pat. No. 5,607,798 provides no information respecting breathability and barrier performance of the described laminate. Significantly, U.S. Pat. No. 5,607,798 does not teach the specific or separate densification or recrystallization of meltblown layers.

WO 96/17119, the disclosure of which is incorporated herein by reference, spunbond and meltblown fibers made from metallocene catalyzed polyethylene wherein the polyethylene has a density greater than 0.940 grams/$cm^3$. WO 96/17119 provides no hydrohead performance information for meltblown layers or SMS structures, does not describe specific or separate densification and/or recrystallization of the meltblown layers and only exemplifies meltblown layers having a basis weight of 68 grams/$m^2$.

WO 97/29909, the disclosure of which is incorporated herein by reference, describes a clothlike microporous laminate made by incrementally stretching a lamination of a microporous film and nonwoven fibrous web. The laminate allegedly has air and moisture vapor permeabilities and acts as a barrier to the passage of liquids.

WO 97/30843 describes a fully elastic, breathable, barrier fabric comprising a nonwoven web layer of fibers of less than 40 microns in average diameter, wherein the web has a hydrohead performance of at least 10 millibars, a Frazier Permeability of at least 100 cfm, a basis weight of less than 68 g/$m^2$ and which is made from an elastic polymer e.g. ENGAGE™ elastomer supplied by Dupont Dow Elastomers. However, all of the inventive examples in WO 97/30843 show a hydrohead performance of less than or equal to 14 millibars. Further, the exemplified control SMS sample in WO 97/30843, which consists of all nonelastic layers, shows a high hydrohead performance and excessively low permeability. This performance is consistent with the expectations of a person skilled in the art. That is, nonelastic materials are ordinarily characterized as having higher crystallinities and high crystallinity is expected to provide good barrier properties e.g. high hydrohead performance but low permeability e.g. low moisture vapor transmission rates (MVTR).

WO 97/30202, the disclosure of which is also incorporated herein by reference, also describes an elastic meltblown layer. However, the hydrohead performance of the inventive examples 1 and 2 in WO 97/30202 are disclosed to be 5.2 and 7.2 millibars, respectively. Further, WO 97/30202 describes a comparative example 4 as a polypropylene/polypropylene/polypropylene SMS structure having a hydrohead performance of 33.6 millibars. However, the hydrohead performance of the meltblown layer is not disclosed nor is the exact basis weights for the individual layers. Conversely, the basis weight ratio between the spunbond and meltblown layers of comparative example 4 in WO 97/30202 is disclosed to be between about 1:1 and 1:4, i.e. the spunbond layers constitute about 20–50 percent by weight of the SMS structure.

Because there is no description in the art of a thermoplastic meltblown layer having good breathability and good barrier properties, there is a present need for such. In particular, there is a need for a thermoplastic meltblown layer characterized as having a basis weight less than or equal to 67 g/$m^2$, a MVTR greater than or equal to 1,500 g/m$^2$/day, and substantially improved hydrohead performance. There also is a need for a spunbond/meltblown (SM) structure characterized as having a cloth-like feel and softness, a basis weight in the range of from about 12 to about 105 g/m$^2$, a MVTR greater than or equal to 1,500 g/m$^2$/day, and a hydrohead performance greater than or equal to 45 millibars. There is also a need for a method for making the above described novel meltblown layer. There is a further need to provide a high barrier meltblown layer with good elasticity. These and other objects are met by the invention herein described.

SUMMARY OF THE INVENTION

We have discovered that by separately secondarily processing a thermoplastic meltblown fibrous web, the barrier properties of the web can be greatly enhanced while maintaining the high permeability of the web. Although we do not want to be held to any particular theory that might explain the invention, separate secondary processing of a thermoplastic meltblown web, for example, by thermally bonding the fibrous web between two smooth rolls at an elevated temperature and pressure and an effective residence time is believed to effectuate densification or recrystallization of the thermoplastic fibers which unexpectedly provides enhanced barrier properties. These results are unexpected in that while polymers of higher densities are expected to exhibit improved barrier properties, we found that separate secondary processing improves the barrier properties of semicrystalline (i.e. having polymer crystallinities greater than 27 percent as determined by differential scanning calorimetry) thermoplastic polymers and the percent improvement increasing as crystallinity increases.

The broad aspect of the invention is a method of making an improved meltblown fibrous layer characterized as having:

(a) a hydrohead performance at least 16.5 percent greater than the hydrohead of a first meltblown layer, (b) a basis weight less than 67 g/m$^2$ and equal to or less than the basis weight of the first meltblown layer, and (c) a water or moisture vapor transmission rate within at least 88 percent of the first meltblown layer, the method comprising separate secondary processing of the first meltblown layer at an elevated temperature, an elevated pressure and a residence time which equates to a roll speed of less than 20 feet/minute to effectuate the improvement.

Another aspect of the invention is a meltblown nonwoven fibrous layer comprising a thermoplastic polymer composition and characterized as having a hydrohead greater than 40 millibars and a basis weight less than 67 grams/m$^2$.

Third aspect of the invention is a breathable, barrier fabric comprising at least one meltblown nonwoven fibrous layer adjacent to at least one spunbond nonwoven fibrous layer, the at least one meltblown layer comprising a thermoplastic polymer and characterized as having a hydrohead greater than 40 millibars and a basis weight less than 67 grams/m$^2$.

In one preferred embodiment, the meltblown layer comprises an elastic material incorporated, for example, by a conjugated meltblowing technique (preferably, a side by side configuration) or, alternately, by direct lamination or fiber interlayment during or following the separate secondary processing step.

In another preferred embodiment, the spunbond/meltblown structure is a spunbond/meltblown/spunbond (SMS) structure comprising the inventive meltblown layer and especially a spunbond/meltblown/meltblown/spunbond (SMMS) structure comprising the inventive meltblown layer.

One advantage of the invention is now practitioners can make breathable, barrier fabrics that are fully nonwoven. Another advantage is practitioners can make breathable, barrier fabrics that are fully constructed from thermoplastic polymers, or in some instances all from a single thermoplastic polymer type or chemistry (e.g., use two different ethylene polymers), or in specific instances from a single thermoplastic polymer.

DETAILED DESCRIPTION OF THE INVENTION

Figure 1:
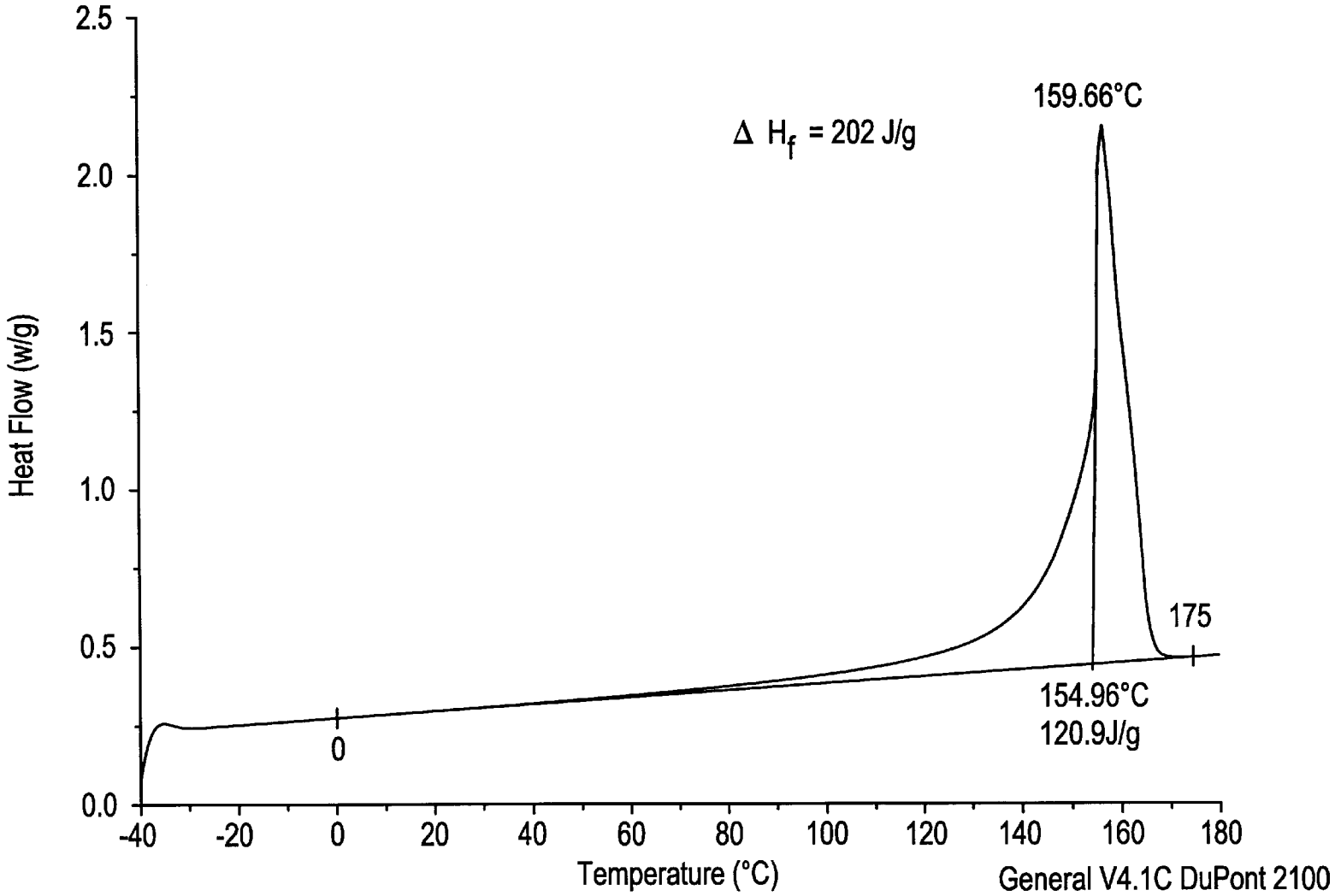
FIG. 1 is a differential scanning calorimetry (DSC) melting curve for ESCORENE PP 3546G, a polypropylene polymer supplied by Exxon Chemical Company.

The term "separate secondary processing" as used herein means after the initial fabrication of the meltblown layer, the meltblown fibers are then subjected to at a residence time which equates to a roll speed in the range of about 20 to about 75 feet/minute at an elevated temperature of, for example, at least 150° F. and an elevated pressure of, for example, at least 250 psi prior to being bonded to other materials or layers such as bonding to spunbond fibers or a spunbond fibrous layer. As the term "separate secondary processing" is used herein, bonding of meltblown fibers to spunbond fibers or a layer (without additional processing or treatment after the separate secondary processing step, except, perhaps natural or slow cooling where, for example, quick quenching would be considered additional processing or treatment) would constitute at least a third heat history or tertiary processing step for the meltblown fibers where the initial meltblowing itself would constitute the primary processing step.

The term "meltblown" is used herein in the conventional sense to refer to fibers formed by extruding a molten thermoplastic polymer composition through a plurality of fine, usually circular, die capillaries as molten threads or filaments into converging high velocity gas streams (e.g. air) which function to attenuate the threads or filaments to reduced diameters. Thereafter, the filaments or threads are carried by the high velocity gas streams and deposited on a collecting surface to form a web of randomly dispersed meltblown fibers with average diameters generally smaller than 10 microns.

The term "spunbond" is used herein in the conventional sense to refer to fibers formed by extruding a molten thermoplastic polymer composition as filaments through a plurality of fine, usually circular, die capillaries of a spinneret with the diameter of the extruded filaments then being rapidly reduced and thereafter depositing the filaments onto a collecting surface to form a web of randomly dispersed spunbond fibers with average diameters generally between about 7 and about 30 microns.

The term "nonwoven" as used herein and in the conventional sense means a web or fabric having a structure of individual fibers or threads which are randomly interlaid, but not in an identifiable manner as is the case for a knitted fabric.

The term "conjugated" refers to fibers which have been formed from at least two polymers extruded from separate extruders but meltblown together to form one fiber. Conjugated fibers are sometimes referred to in the art as multicomponent or bicomponent fibers. The polymers are usually different from each other although conjugated fibers may be monocomponent fibers. The polymers are arranged in substantially constantly positioned distinct zones across the cross-section of the conjugated fibers and extend continuously along the length of the conjugated fibers. The configuration of conjugated fibers can be, for example, a sheath/core arrangement (wherein one polymer is surrounded by another), a side by side arrangement, a pie arrangement or an "islands-in-the sea" arrangement. Conjugated fibers are described in U.S Pat. No. 5,108,820 to Kaneko et al.; U.S. Pat. No. 5,336,552 to Strack et al.; and U.S. Pat. No. 5,382,400 to Pike et al., the disclosures of all of which are incorporated herein by reference.

The term "elastic" as used herein refers to a material having a permanent set of less than 15 percent (i.e. greater than 85 percent recovery) at 200 percent strain and is stretchable to a stretched, biased length at least 150 percent greater than its relaxed, unstretched length. Elastic materials are also referred to in the art as "elastomers" and "elastomeric".

Conversely, the term "nonelastic" as used herein refers to a material which is not "elastic" as the term "elastic" is used and defined herein.

The improved meltblown layer of the present invention has a comparative hydrohead performance of at least 16.5 percent, preferably at least 30 percent, more preferably at least 40 greater than the hydrohead of the first meltblown layer (i.e., the layer before subjected to separate secondary processing), as determined by hydrohead testing at 1 centimeter water/second in accordance with the American Association of Textile Chemists and Colorist Test Method 127–1989, at a basis weight less than 67 g/m$^2$, preferably in the range from about 10 to about 65 g/m$^2$, more preferably in the range of from about 25 to about 40 g/m$^2$ and equal to or less than the basis weight of the first meltblown layer.

Preferably, the hydrohead of the inventive meltblown layer is greater than or equal to 45 millibars and more preferably greater than or equal to 50 millibars at a basis weight less than 67 g/m$^2$, preferably in the range from about 10 to about 65 g/m$^2$, more preferably in the range of from about 25 to about 40 g/m$^2$ Alternately, the inventive meltblown layer may be characterized as preferably having a hydrohead performance at 1 centimeter water/second in accordance with Federal Test Standard No. 191A, Method 5514 of greater than or equal to 1.3 millibar/1 gram/m$^2$ of basis weight or more preferably greater than or equal to 1.5 millibar/1 gram/m$^2$ of basis weight.

The inventive meltblown layer is also characterized as having a water or moisture vapor transmission rate that is within at least 88 percent, preferably within 90 percent of the water or moisture vapor transmission rate of the first meltblown layer and is at least 1,500 g/m$^2$/day, preferably in the range of about 2,500 to about 4,500 g/m$^2$/day, as determined in accordance with ASTM E96.

The first meltblown layer can be manufactured using known meltblowing techniques. However, the separate secondary processing of the first meltblown layer must be sufficient to provide the desired hydrohead improvement and retention of permeability performance. In general, higher temperatures and pressures and residences times provide improved hydrohead performance. The elevated temperature should be high enough to effectively heat the meltblown layers without being high enough to cause substantial softening or melting or especially sticking to the secondary processing equipment. Preferably, the elevated temperature of the separate secondary processing is at least 150° F., more preferably at least 160° F. and the elevated pressure, where calender rolls are employed should preferably be at least 250 psi, more preferably at least 1,000 psi. However, where a roll stack is employed to effectuate the separate secondary processing, the associated pressure will be minimal.

In general, for polymer compositions characterized as having a lower polymer crystallinity (i.e., less than 65 percent as determined using differential scanning calorimetry (DSC)), the residence time of the separate secondary processing should equate to a roll speed greater than 63 feet/minute, preferably greater than 50 feet/minute. However, the residence time of the separate secondary processing should not exceed a time that equates to a roll speed of 20 feet/minute as, for example, ill-effects of thermal degradation may occur.

The separate secondary processing of the first meltblown layer can be accomplished by any suitable means, including, but not limited to, thermal bonding, thermal point bonding, ultra-sonic bonding and through-air bonding, and combinations thereof. One suitable, separate secondary processing step includes passing the first meltblown layer through addition of nip rolls, calender rolls or a roll stack prior to bonding with other materials or layers. One preferred separate second processing step comprises thermally bonding the first meltblown layer between at least two calender rolls having sufficiently smooth nonstick surfaces. That is, the surfaces of the rolls are rough enough to minimize adhesion or sticking, yet not rough enough to be considered embossed. Such preferred rolls will have a rms value of less than 20, more preferably less than 10.

The bonding of the inventive meltblown layer to other materials or layers such as to a spunbond layer to prepare the SM structure of the present invention can be accomplished by any suitable means known in the art, including, but not limited to, thermal bonding, thermal point bonding, ultrasonic bonding and through-air bonding, and combinations thereof.

The inventive meltblown layer (and preferably, the at least one spunbond layer of the inventive SM structure) comprises a thermoplastic polymer or composition. Suitable thermoplastics are commercially available from a variety of suppliers and include, but are not limited, an ethylene polymer (e.g., low density polyethylene, ultra or very low density polyethylene, medium density polyethylene, linear low density polyethylene, high density polyethylene, homogeneously branched linear ethylene polymer, substantially linear ethylene polymer, polystyrene, ethylene styrene interpolymer, ethylene vinyl acetate interpolymer, ethylene acrylic acid interpolymer, ethylene ethyl acetate interpolymer, ethylene methacrylic acid interpolymer, ethylene methacrylic acid ionomer, and the like), polycarbonate, polystyrene, polypropylene (e.g., homopolymer polypropylene, polypropylene copolymer, random block polypropylene interpolymer and the like), thermoplastic polyurethane, polyamide, polylactic acid interpolymer, thermoplastic block polymer (e.g. styrene butadiene copolymer, styrene butadiene styrene triblock copolymer, styrene ethylene-butylene styrene triblock copolymer and the like), polyether block copolymer (e.g., PEBAX), copolyester polymer, polyester/polyether block polymers (e.g., HYTEL), ethylene carbon monoxide interpolymer (e.g., ethylene/carbon monoxide (ECO), copolymer, ethylene/acrylic acid/carbon monoxide (EAACO) terpolymer, ethylene/methacrylic acid/carbon monoxide (EMAACO) terpolymer, ethylene/vinyl acetate/carbon monoxide (EVACO) terpolymer and styrene/carbon monoxide (SCO)), polyethylene terephthalate (PET), chlorinated polyethylene, and mixtures thereof.

Preferably, the inventive meltblown layer comprises a thermoplastic polymer characterized as having a crystallinity of greater than or equal to 50 percent, more preferably greater than or equal to 70 percent and most preferably greater than or equal 85 percent.

Preferably, the inventive meltblown layer (and more preferably, the at least one spunbond layer of the inventive SM structure) comprise an ethylene polymer and/or a polypropylene, and more preferably a metallocene-catalyzed ethylene polymer and/or polypropylene such as AFFINITY™ plastomers supplied by The Dow Chemical Company and ACHIEVE resins supplied by Exxon Chemical Company.

As the spunbond layers dictate the strength, feel and softness of the SM structure, in specific embodiments of the present invention, the at least one spunbond layer of the inventive SM structure comprises an elastic material with good softness and feel.

Where polypropylene is used in the inventive meltblown layer, the melt flow rate (MFR) should preferably be between about 300 and 3,000 g/10 minutes, and more preferably between about 400 and 2,000 g/10 minutes, as measured in accordance with ASTM D-1238, Condition 230° C./2.16 kg (formerly known as "Condition L"); the density should preferably be between about 0.90 and 0.92 g/cm$^3$, as measured in accordance with ASTM D-792A-2; and the isotacticity index should preferably be greater than or equal to 80 percent, more preferably greater than or equal to 85 percent and most preferably greater than or equal to 90 percent.

Where polypropylene is used in the spunbond layers of the inventive SMS structure, the MFR should preferably be between about 20 and 50 g/10 minutes, and more preferably between about 30 and 40 g/10 minutes, as measured in accordance with ASTM D-1238, Condition 230° C./2.16 kg.

Where polyethylene is used in the inventive meltblown layer, the 12 melt index should preferably be between about 60 and 300 g/10 minutes, and more preferably between about 100 and 150 g/10 minutes, as measured in accordance with ASTM D-1238, Condition 190° C./2.16 kg (formerly known as "Condition E"); the polymer density should preferably be greater than 0.93 g/cm$^3$, as measured in accordance with ASTM D-792; and the crystallinity as determined using DSC should preferably be greater than or equal to 60 percent and more preferably greater than or equal to 65 percent Where polyethylene is used in the spunbond layers of the inventive SMS structure, the $I_2$ melt index should preferably be between about 10 and 100 g/10 minutes, and more preferably between about 15 and 35 g/10 minutes, as measured in accordance with ASTM D-1238, Condition 190° C./2.16 kg; the polymer density should preferably be less than or equal to 0.93 g/cm$^3$, as measured in accordance with ASTM D-792; and the crystallinity as determined using DSC should preferably to be less than or equal to 65 percent and more preferably less than or equal to 35 percent.

The term "polymer", as used herein, refers to a polymeric compound prepared by polymerizing monomers, whether of the same or a different type. As used herein, generic term "polymer" embraces the terms "homopolymer," "copolymer," "terpolymer" as well as "interpolymer."

The term "interpolymer", as used herein refers to polymers prepared by the polymerization of at least two different types of monomers. As used herein the generic term "interpolymer" includes the term "copolymers" (which is usually employed to refer to polymers prepared from two different monomers) as well as the term "terpolymers" (which is usually employed to refer to polymers prepared from three different types of monomers).

The term "homogeneously branched ethylene polymer" is used herein in the conventional sense to refer to an ethylene interpolymer in which the comonomer is randomly distributed within a given polymer molecule and wherein substantially all of the polymer molecules have the same ethylene to comonomer molar ratio. The term refers to an ethylene interpolymer that is characterized by a relatively high short chain branching distribution index (SCBDI) or composition distribution branching index (CDBI), i.e., a uniform short chain branching distribution.

Homogeneously branched ethylene polymers have a SCBDI greater than or equal to 50 percent, preferably greater than or equal to 70 percent, more preferably greater than or equal to 90 percent. Preferably, the homogeneously branched ethylene polymer is defined as having a narrow, essentially single melting TREF profile/curve and essentially lacking a measurable high density polymer portion (i.e. the polymer does not contain a polymer fraction with a degree of short chain branching less than or equal to 2 methyls/1000 carbons nor equal to or greater than about 30 methyls/1000 carbons or, alternatively, at densities less than 0.936 g/cc, the polymer does not contain a polymer fraction eluting at temperatures greater than 95° C.), as determined using a temperature rising elution fractionation technique (abbreviated herein as "TREF").

SCBDI is defined as the weight percent of the polymer molecules having a comonomer content within 50 percent of the median total molar comonomer content and represents a comparison of the monomer distribution in the interpolymer to the monomer distribution expected for a Bernoullian distribution. The SCBDI of an interpolymer can be readily calculated from TREF as described, for example, by Wild et al., *Journal of Polymer Science, Poly. Phys. Ed.*, Vol. 20, p. 441 (1982), or in U.S. Pat. Nos. 4,798,081; 5,008,204; or by L. D. Cady, "The Role of Comonomer Type and Distribution in LLDPE Product Performance," SPE Regional Technical Conference, Quaker Square Hilton, Akron, Ohio, October 1–2, pp. 107–119 (1985), the disclosures of all which are incorporated herein by reference. However, the preferred TREF technique does not include purge quantities in SCBDI calculations. More preferably, the monomer distribution of the interpolymer and SCBDI are determined using $^{13}$C NMR analysis in accordance with techniques described in U.S. Pat. No. 5,292,845; U.S. Pat. No. 4,798,081; U.S. Pat. No. 5,089,321 and by J. C. Randall, *Rev. Macromol. Chem. Phys.*, C29, pp. 201–317, the disclosures of all of which are incorporated herein by reference.

In analytical temperature rising elution fractionation analysis (as described in U.S. Pat. No. 4,798,081 and abbreviated herein as "ATREF"), the film or composition to be analyzed is dissolved in a suitable hot solvent (e.g., trichlorobenzene) and allowed to crystallized in a column containing an inert support (stainless steel shot) by slowly reducing the temperature. The column is equipped with both a refractive index detector and a differential viscometer (DV) detector. An ATREF-DV chromatogram curve is then generated by eluting the crystallized polymer sample from the column by slowly increasing the temperature of the eluting solvent (trichlorobenzene). The ATREF curve is also frequently called the short chain branching distribution (SCBD), since it indicates how evenly the comonomer (e.g., octene) is distributed throughout the sample in that as elution temperature decreases, comonomer content increases. The refractive index detector provides the short chain distribution information and the differential viscometer detector provides an estimate of the viscosity average molecular weight. The short chain branching distribution and other compositional information can also be determined using crystallization analysis fractionation such as the CRYSTAF fractionalysis package available commercially from PolymerChar, Valencia, Spain.

Preferred homogeneously branched ethylene polymers (such as, but not limited to, substantially linear ethylene polymers) have a single melting peak between −30 and 150° C., as determined using differential scanning calorimetry (DSC), as opposed to traditional Ziegler polymerized heterogeneously branched ethylene polymers (e.g., LLDPE and ULDPE or VLDPE) which have two or more melting points.

However, those homogeneously branched ethylene polymers having a density of about 0.875 g/cm$^3$ to about 0.91 g/cm$^3$, the single melt peak may show, depending on equipment sensitivity, a "shoulder" or a "hump" on the side low of the melting peak (i.e. below the melting point) that constitutes less than 12 percent, typically, less than 9 percent, more typically less than 6 percent of the total heat of fusion of the polymer. This artifact is due to intra-polymer chain variations, and it is discerned on the basis of the slope of the single melting peak varying monotonically through the melting region of the artifact. The artifact occurs within 34° C., typically within 27° C., and more typically within 20° C. of the melting point of the single melting peak.

The single melting peak is determined using a differential scanning calorimeter standardized with indium and deionized water. The method involves about 5–7 mg sample sizes, a "first heat" to about 150° C. which is held for 4 minutes, a cool down at 10° C./min. to −30° C. which is held for 3 minutes, and heat up at 10° C./min. to 150° C. to provide a "second heat" heat flow vs. temperature curve. Total heat of fusion of the polymer is calculated from the area under the curve. The heat of fusion attributable to this artifact, if present, can be determined using an analytical balance and weight-percent calculations.

The homogeneously branched ethylene polymers for use in the invention can be either a substantially linear ethylene polymer or a homogeneously branched linear ethylene polymer. Most preferably, the homogeneously branched ethylene polymer is a substantially linear ethylene polymer due to its unique rheological properties.

The term "linear" as used herein means that the ethylene polymer does not have long chain branching. That is, the polymer chains comprising the bulk linear ethylene polymer have an absence of long chain branching, as in the case of traditional linear low density polyethylene polymers or linear high density polyethylene polymers made using Ziegler polymerization processes (e.g., U.S. Pat. No. 4,076,698 (Anderson et al.)), sometimes called heterogeneous polymers. The term "linear" does not refer to bulk high pressure branched polyethylene, ethylene/vinyl acetate copolymers, or ethylene/vinyl alcohol copolymers which are known to those skilled in the art to have numerous long chain branches.

The term "homogeneously branched linear ethylene polymer" refers to polymers having a narrow short chain branching distribution and an absence of long chain branching. Such "linear" uniformly branched or homogeneous polymers include those made as described in U.S. Pat. No. 3,645,992 (Elston) and those made using socalled single site catalysts in a batch reactor having relatively high ethylene concentrations (as described in U.S. Pat. No. 5,026,798 (Canich) or in U.S. Pat. No. 5,055,438 (Canich)) or those made using constrained geometry catalysts in a batch reactor also having relatively high olefin concentrations (as described in U.S. Pat. No. 5,064,802 (Stevens et al.) or in EP 0 416 815 A2 (Stevens et al.)).

Typically, homogeneously branched linear ethylene polymers are ethylene/α-olefin interpolymers, wherein the α-olefin is at least one $C_3$–$C_{20}$ α-olefin (e.g., propylene, 1-butene, 1-pentene, 4-methyl-1-pentene, 1-hexene, 1-heptene and 1-octene) and preferably the at least one $C_3$–$C_{20}$ α-olefin is 1-butene, 1-hexene, 1heptene or 1-octene. Most preferably, the ethylene/α-olefin interpolymer is a copolymer of ethylene and a $C_3$–$C_{20}$ α-olefin, and especially an ethylene/$C_4$–$C_8$ α-olefin copolymer such as an ethylene/1-octene copolymer, ethylene/1-butene copolymer, ethylene/1-pentene copolymer, ethylene/1-heptene copolymer, or ethylene/1-hexene copolymer.

Suitable homogeneously branched linear ethylene polymers for use in the invention are sold under the designation of TAFMER by Mitsui Chemical Corporation and under the designations of EXACT and EXCEED resins by Exxon Chemical Company.

The homogeneously branched ethylene polymers and polypropylene polymers suitable for use in the present invention can optionally be blended with at least one other polymer. Suitable polymers for blending with homogeneously branched ethylene polymers and polypropylene polymers include, for example, a low density polyethylene homopolymer, substantially linear ethylene polymer, homogeneously branched linear ethylene polymers, heterogeneously branched linear ethylene polymers (i.e., linear low density polyethylene (LLDPE), ultra or very low density polyethylene (ULDPE), medium density polyethylene (MDPE), and high density polyethylene (HDPE) such as those manufactured using a Ziegler-Natta catalyst system) as well as polystyrene, polypropylene, ethylene propylene polymers, EPDM, ethylene propylene rubber, ethylene styrene interpolymers and the like.

The term "substantially linear ethylene polymer" as used herein means that the bulk ethylene polymer is substituted, on average, with about 0.01 long chain branches/1000 total carbons to about 3 long chain branches/1000 total carbons (wherein "total carbons" includes both backbone and branch carbons). Preferred polymers are substituted with about 0.01 long chain branches/1000 total carbons to about 1 long chain branches/1000 total carbons, more preferably from about 0.05 long chain branches/1000 total carbons to about 1 long chain branched/1000 total carbons, and especially from about 0.3 long chain branches/1000 total carbons to about 1 long chain branches/1000 total carbons.

As used herein, the term "backbone" refers to a discrete molecule, and the term "polymer" or "bulk polymer" refers, in the conventional sense, to the polymer as formed in a reactor. For the polymer to be a "substantially linear ethylene polymer", the polymer must have at least enough molecules with long chain branching such that the average long chain branching in the bulk polymer is at least an average of from about 0.01/1000 total carbons to about 3 long chain branches/1000 total carbons.

The term "bulk polymer" as used herein means the polymer which results from the polymerization process as a mixture of polymer molecules and, for substantially linear ethylene polymers, includes molecules having an absence of long chain branching as well as molecules having long chain branching. Thus a "bulk polymer" includes all molecules formed during polymerization. It is understood that, for the substantially linear polymers, not all molecules have long chain branching, but a sufficient amount do such that the average long chain branching content of the bulk polymer positively affects the melt rheology (i.e., the melt fracture properties) as described herein below and elsewhere in the literature.

Long chain branching (LCB) is defined herein as a chain length of at least one (1) carbon less than the number of carbons in the comonomer, whereas short chain branching (SCB) is defined herein as a chain length of the same number of carbons in the residue of the comonomer after it is incorporated into the polymer molecule backbone. For example, a substantially linear ethylene/1-octene polymer has backbones with long chain branches of at least seven (7) carbons in length, but it also has short chain branches of only six (6) carbons in length.

Long chain branching can be distinguished from short chain branching by using $^{13}C$ nuclear magnetic resonance (NMR) spectroscopy and to a limited extent, e.g. for ethylene homopolymers, it can be quantified using the method of Randall, (*Rev. Macromol.Chem. Phys.*, C29 (2&3), p. 285–297), the disclosure of which is incorporated herein by reference. However as a practical matter, current $^{13}C$ nuclear magnetic resonance spectroscopy cannot determine the length of a long chain branch in excess of about six (6) carbon atoms and as such, this analytical technique cannot distinguish between a seven (7) carbon branch and a seventy (70) carbon branch. The long chain branch can be as long as about the same length as the length of the polymer backbone.

Although conventional $^{13}C$ nuclear magnetic resonance spectroscopy cannot determine the length of a long chain branch in excess of six carbon atoms, there are other known techniques useful for quantifying or determining the presence of long chain branches in ethylene polymers, including ethylene/1-octene interpolymers. For example, U.S. Pat. No. 4,500,648, incorporated herein by reference, teaches that long chain branching frequency (LCB) can be represented by the equation $LCB=b/M_W$ wherein b is the weight average number of long chain branches per molecule and $M_w$ is the weight average molecular weight. The molecular weight averages and the long chain branching characteristics are determined by gel permeation chromatography and intrinsic viscosity methods, respectively.

Two other useful methods for quantifying or determining the presence of long chain branches in ethylene polymers, including ethylene/1-octene interpolymers are gel permeation chromatography coupled with a low angle laser light scattering detector (GPC-LALLS) and gel permeation chromatography coupled with a differential viscometer detector (GPC-DV). The use of these techniques for long chain branch detection and the underlying theories have been well documented in the literature. See, e.g., Zimm, G. H. and Stockmayer, W. H., *J. Chem. Phys.*, 17, 1301 (1949) and Rudin, A., *Modern Methods of Polymer Characterization*, John Wiley & Sons, New York (1991) pp. 103–112, the disclosures of both of which are incorporated by reference.

A. Willem deGroot and P. Steve Chum, both of The Dow Chemical Company, at the Oct. 4, 1994 conference of the Federation of Analytical Chemistry and Spectroscopy Society (FACSS) in St. Louis, Missouri, presented data demonstrating that GPC-DV is indeed a useful technique for quantifying the presence of long chain branches in substantially linear ethylene polymers. In particular, deGroot and Chum found that the level of long chain branches in substantially linear ethylene homopolymer samples measured using the Zimm-Stockmayer equation correlated well with the level of long chain branches measured using $^{13}C$ NMR.

Further, deGroot and Chum found that the presence of octene does not change the hydrodynamic volume of the polyethylene samples in solution and, as such, one can account for the molecular weight increase attributable to octene short chain branches by knowing the mole percent octene in the sample. By deconvoluting the contribution to molecular weight increase attributable to 1-octene short chain branches, deGroot and Chum showed that GPC-DV may be used to quantify the level of long chain branches in substantially linear ethylene/octene copolymers.

DeGroot and Chum also showed that a plot of Log($I_2$, melt index) as a function of Log(GPC Weight Average Molecular Weight) as determined by GPC-DV illustrates that the long chain branching aspects (but not the extent of long branching) of substantially linear ethylene polymers are comparable to that of high pressure, highly branched low density polyethylene (LDPE) and are clearly distinct from ethylene polymers produced using Ziegler-type catalysts such as titanium complexes and ordinary homogeneous catalysts such as hafnium and vanadium complexes.

For substantially linear ethylene polymers, the empirical effect of the presence of long chain branching is manifested as enhanced rheological properties which are quantified and expressed in terms of gas extrusion rheometry (GER) results and/or melt flow, $I_{10}/I_2$, increases.

The substantially linear ethylene polymers used in the present invention are a unique class of compounds that are further defined in U.S. Pat. No. 5,272,236, application number 07/776,130, filed Oct. 15, 1991; U.S. Pat. No. 5,278,272, application number 07/939,281, filed Sep. 2, 1992; and U.S. Pat. No. 5,665,800, application number 08/730,766, filed Oct. 16, 1996, each of which is incorporated herein by reference.

Substantially linear ethylene polymers differ significantly from the class of polymers conventionally known as homogeneously branched linear ethylene polymers described above and, for example, by Elston in U.S. Pat. No. 3,645,992. As an important distinction, substantially linear ethylene polymers do not have a linear polymer backbone in the conventional sense of the term "linear" as is the case for homogeneously branched linear ethylene polymers. Substantially linear ethylene polymers also differ significantly from the class of polymers known conventionally as heterogeneously branched traditional Ziegler polymerized linear ethylene interpolymers (for example, ultra low density polyethylene, linear low density polyethylene or high density polyethylene made, for example, using the technique disclosed by Anderson et al. in U.S. Pat. No. 4,076,698, in that substantially linear ethylene interpolymers are homogeneously branched polymers; that is, substantially linear ethylene polymers have a SCBDI greater than or equal to 50 percent, preferably greater than or equal to 70 percent, more preferably greater than or equal to 90 percent. Substantially linear ethylene polymers also differ from the class of heterogeneously branched ethylene polymers in that substantially linear ethylene polymers are characterized as essentially lacking a measurable high density or crystalline polymer fraction as determined using a temperature rising elution fractionation technique.

The substantially linear ethylene polymer for use in the present invention is characterized as having (a) melt flow ratio, $I_{10}/I_2 \geqq 5.63$, (b) a molecular weight distribution, $M_w/M_n$, as determined by gel permeation chromatography and defined by the equation:

$$(M_w/M_n) \leqq (I_{10}/I_2) - 4.63,$$

(c) a gas extrusion rheology such that the critical shear rate at onset of surface melt fracture for the substantially linear ethylene polymer is at least 50 percent greater than the critical shear rate at the onset of surface melt fracture for a linear ethylene polymer, wherein the substantially linear ethylene polymer and the linear ethylene polymer comprise the same comonomer or comonomers, the linear ethylene polymer has an $I_2$ and $M_w/M_n$ within ten percent of the substantially linear ethylene polymer and wherein the respective critical shear rates of the substantially linear ethylene polymer and the linear ethylene polymer are measured at the same melt temperature using a gas extrusion rheometer, (d) a single differential scanning calorimetry, DSC, melting peak between −30° and 150° C., and (e) a short chain branching distribution index greater than 50 percent.

Determination of the critical shear rate and critical shear stress in regards to melt fracture as well as other rheology properties such as "rheological processing index" (PI), is performed using a gas extrusion rheometer (GER). The gas extrusion rheometer is described by M. Shida, R. N. Shroff and L. V. Cancio in *Polymer Engineering Science*, Vol. 17, No. 11, p. 770 (1977) and in *Rheometers for Molten Plastics* by John Dealy, published by Van Nostrand Reinhold Co. (1982) on pp. 97–99, the disclosures of both of which are incorporated herein by reference.

The processing index (PI) is measured at a temperature of 190° C., at nitrogen pressure of 2500 psig using a 0.0296 inch (752 micrometers) diameter (preferably a 0.0143 inch diameter die for high flow polymers, e.g. 50–100 $I_2$ melt index or greater), 20:1 L/D die having an entrance angle of 180°. The GER processing index is calculated in millipoise units from the following equation:

$$PI=2.15\times10^6 \text{ dyne/cm}^2/(1000\times\text{shear rate}),$$

where: $2.15\times10^6$ dyne/cm$^2$ is the shear stress at 2500 psi, and the shear rate is the shear rate at the wall as represented by the following equation:

$$32\ Q'/(60 \text{ sec/min})(0.745)(\text{Diameter}\times2.54 \text{ cm/in})^3,$$

where:

Q' is the extrusion rate (gms/min), 0.745 is the melt density of polyethylene (gm/cm$^3$), and Diameter is the orifice diameter of the capillary (inches).

The PI is the apparent viscosity of a material measured at apparent shear stress of $2.15\times10^6$ dyne/cm$^2$.

For substantially linear ethylene polymers, the PI is less than or equal to 70 percent of that of a conventional linear ethylene polymer having an $I_2$, $M_w/M_n$ and density each within ten percent of the substantially linear ethylene polymer.

An apparent shear stress vs. apparent shear rate plot is used to identify the melt fracture phenomena over a range of nitrogen pressures from 5250 to 500 psig using the die or GER test apparatus previously described. According to Ramamurthy in *Journal of Rheology*. 30(2), 337–357, 1986, above a certain critical flow rate, the observed extrudate irregularities may be broadly classified into two main types: surface melt fracture and gross melt fracture.

Surface melt fracture occurs under apparently steady flow conditions and ranges in detail from loss of specular gloss to the more severe form of "sharkskin". In this disclosure, the onset of surface melt fracture is characterized at the beginning of losing extrudate gloss at which the surface roughness of extrudate can only be detected by 40x magnification. The critical shear rate at onset of surface melt fracture for the substantially linear ethylene polymers is at least 50 percent greater than the critical shear rate at the onset of surface melt fracture of a linear ethylene polymer having about the same $I_2$ and $M_w/M_n$. Preferably, the critical shear stress at onset of surface melt fracture for the substantially linear ethylene polymers of the invention is greater than about $2.8\times10^6$ dyne/cm$^2$.

Gross melt fracture occurs at unsteady flow conditions and ranges in detail from regular (alternating rough and smooth, helical, etc.) to random distortions. For commercial acceptability, (e.g., in blown film products), surface defects should be minimal, if not absent. The critical shear rate at onset of surface melt fracture (OSMF) and critical shear stress at onset of gross melt fracture (OGMF) will be used herein based on the changes of surface roughness and configurations of the extrudates extruded by a GER. For the substantially linear ethylene polymers used in the invention, the critical shear stress at onset of gross melt fracture is preferably greater than about $4\times10^6$ dyne/cm$^2$.

For the processing index determination and for the GER melt fracture determination, substantially linear ethylene polymers are tested without inorganic fillers and do not have more than 20 ppm aluminum catalyst residue. Preferably, however, for the processing index and melt fracture tests, substantially linear ethylene polymers do contain antioxidants such as phenols, hindered phenols, phosphites or phosphonites, preferably a combination of a phenol or hindered phenol and a phosphite or a phosphonite.

The molecular weight distributions of ethylene polymers are determined by gel permeation chromatography (GPC) on a Waters 150C high temperature chromatographic unit equipped with a differential refractometer and three columns of mixed porosity. The columns are supplied by Polymer Laboratories and are commonly packed with pore sizes of $10^3$, $10^4$, $10^5$ and $10^6$ Å. The solvent is 1,2,4-trichlorobenzene, from which about 0.3 percent by weight solutions of the samples are prepared for injection. The flow rate is about 1.0 milliliters/minute, unit operating temperature is about 140° C. and the injection size is about 100 microliters.

The molecular weight determination with respect to the polymer backbone is deduced by using narrow molecular weight distribution polystyrene standards (from Polymer Laboratories) in conjunction with their elution volumes. The equivalent polyethylene molecular weights are determined by using appropriate Mark-Houwink coefficients for polyethylene and polystyrene (as described by Williams and Ward in *Journal of Polymer Science*, Polymer Letters, Vol. 6, p. 621, 1968, the disclosure of which is incorporated herein by reference) to derive the following equation:

$$M_{polyethylene}=a^*(M_{polystyrene})^b.$$

In this equation, a =0.4316 and b=1.0. Weight average molecular weight, $M_w$, is calculated in the usual manner according to the following formula: $Mj=(\Sigma w_i(M_i^j))^{1/j}$; where $w_i$ is the weight fraction of the molecules with molecular weight $M_i$ eluting from the GPC column in fraction i and j=1 when calculating $M_w$ and j=−1 when calculating $M_n$.

For the at least one homogeneously branched ethylene polymer used in the present invention, the $M_w/M_n$ is preferably less than 3.5, more preferably less than 3.0, most preferably less than 2.5, and especially in the range of from about 1.5 to about 2.5 and most especially in the range from about 1.8 to about 2.3.

Substantially linear ethylene polymers are known to have excellent processability, despite having a relatively narrow molecular weight distribution (that is, the $M_w/M_n$ ratio is typically less than about 3.5). Surprisingly, unlike homogeneously and heterogeneously branched linear ethylene polymers, the melt flow ratio ($I_{10}/I_2$) of substantially linear ethylene polymers can be varied essentially independently of the molecular weight distribution, $M_w/M_n$. Accordingly, especially when good extrusion processability is desired, the preferred ethylene polymer for use in the present invention is a homogeneously branched substantially linear ethylene interpolymer.

Suitable constrained geometry catalysts for use manufacturing substantially linear ethylene polymers include constrained geometry catalysts as disclosed in U.S. application Ser no. 07/545,403, filed Jul. 3, 1990; U.S. application Ser. No. 07/758,654, filed Sep. 12, 1991; U.S. Pat. No. 5,132,380 (application Ser. No. 07/758,654); U.S. Pat. No. 5,064,802 (application Ser. No. 07/547,728); U.S. Pat. No. 5,470,993 (application Ser. No. 08/241,523); U.S. Pat. No. 5,453,410 (application Ser. No. 08/108,693); U.S. Pat. No. 5,374,696 (application Ser. No. 08/08,003); U.S. Pat. No. 5,532,394 (application Ser. no. 08/295,768); U.S. Pat. No. No. 5,494,874 (application Ser. No. 08/294,469); and U.S. Pat. No. 5,189,192 (application Ser No. 07/647,111), the teachings of all of which are incorporated herein by reference.

Suitable catalyst complexes may also be prepared according to the teachings of WO 93/08199, and the patents issuing therefrom, all of which are incorporated herein by reference. Further, the monocyclopentadienyl transition metal olefin polymerization catalysts taught in U.S. Pat. No. 5,026,798, which is incorporated herein by reference, are also believed to be suitable for use in preparing the polymers of the present invention, so long as the polymerization conditions substantially conform to those described in U.S. Pat. No. 5,272,236; U.S. Pat. No. 5,278,272 and U.S. Pat. No. 5,665,800, especially with strict attention to the requirement of continuous polymerization. Such polymerization methods are also described in PCT/U.S. 92/08812 (filed Oct. 15, 1992).

The foregoing catalysts may be further described as comprising a metal coordination complex comprising a metal of groups 3–10 or the Lanthanide series of the Periodic Table of the Elements and a delocalize β-bonded moiety substituted with a constrain-inducing moiety, said complex having a constrained geometry about the metal atom such that the angle at the metal between the centroid of the delocalized, substituted pi-bonded moiety and the center of at least one remaining substituent is less than such angle in a similar complex containing a similar pi-bonded moiety lacking in such constrain-inducing substituent, and provided further that for such complexes comprising more than one delocalized, substituted pi-bonded moiety, only one thereof for each metal atom of the complex is a cyclic, delocalized, substituted pi-bonded moiety. The catalyst further comprises an activating cocatalyst.

Suitable cocatalysts for use herein include polymeric or oligomeric aluminoxanes, especially methyl aluminoxane, as well as inert, compatible, inoncoordinating, ion forming compounds. So called modified methyl aluminoxane (MMAO) is also suitable for use as a cocatalyst. One technique for preparing such modified aluminoxane is disclosed in U.S. Pat. No. 5,041,584, the disclosure of which is incorporated herein by reference. Aluminoxanes can also be made as disclosed in U.S. Pat. No. 5,218,071; U.S. Pat. No. 5,086,024; U.S. Pat. No. 5,041,585; U.S. Pat. No. 5,041,583; U.S. Pat. No. 5,015,749; U.S. Pat. No. 4,960,878; and U.S. Pat. No. 4,544,762, the disclosures of all of which are incorporated herein by reference.

Aluminoxanes, including modified methyl aluminoxanes, when used in the polymerization, are preferably used such that the catalyst residue remaining in the (finished) polymer is preferably in the range of from about 0 to about 20 ppm aluminum, especially from about 0 to about 10 ppm aluminum, and more preferably from about 0 to about 5 ppm aluminum. In order to measure the bulk polymer properties (e.g. PI or melt fracture), aqueous HCl is used to extract the aluminoxane from the polymer. Preferred cocatalysts, however, are inert, noncoordinating, boron compounds such as those described in EP 520732, the disclosure of which is incorporated herein by reference.

Substantially linear ethylene are produced via a continuous (as opposed to a batch) controlled polymerization process using at least one reactor (e.g., as disclosed in WO 93/07187, WO 93/07188, and WO 93/07189, the disclosure of each of which is incorporated herein by reference), but can also be produced using multiple reactors (e.g., using a multiple reactor configuration as described in U.S. Pat. No. 3,914,342, the disclosure of which is incorporated herein by reference) at a polymerization temperature and pressure sufficient to produce the interpolymers having the desired properties. The multiple reactors can be operated in series or in parallel, with at least one constrained geometry catalyst employed in at least one of the reactors.

Substantially linear ethylene polymers can be prepared via the continuous solution, slurry, or gas phase polymerization in the presence of a constrained geometry catalyst, such as the method disclosed in EP 416,815-A, the disclosure of which is incorporated herein by reference. The polymerization can generally be performed in any reactor system known in the art including, but not limited to, a tank reactor(s), a sphere reactor(s), a recycling loop reactor(s) or combinations thereof, any reactor or all reactors operated partially or completely adiabatically, nonadiabatically or a combination of both and the like. Preferably, a continuous loop-reactor solution polymerization process is used to manufacture the substantially linear ethylene polymer used in the present invention.

In general, the continuous polymerization required to manufacture substantially linear ethylene polymers may be accomplished at conditions well known in the prior art for Ziegler-Natta or Kaminsky-Sinn type polymerization reactions, that is, temperatures from 0 to 250° C. and pressures from atmospheric to 1000 atmospheres (100 MPa). Suspension, solution, slurry, gas phase or other process conditions may be employed if desired.

A support may be employed in the polymerization, but preferably the catalysts are used in a homogeneous (i.e., soluble) manner. It will, of course, be appreciated that the active catalyst system forms in situ if the catalyst and the cocatalyst components thereof are added directly to the polymerization process and a suitable solvent or diluent, including condensed monomer, is used in said polymerization process. It is, however, preferred to form the active catalyst in a separate step in a suitable solvent prior to adding the same to the polymerization mixture.

The substantially linear ethylene polymers used in the present invention are interpolymers of ethylene with at least one $C_3$–$C_{20}$ α-olefin and/or $C_4$–$C_{18}$ diolefin. Copolymers of ethylene and an α-olefin of $C_3$–$C_{20}$ carbon atoms are especially preferred. The term "interpolymer" as discussed above is used herein to indicate a copolymer, or a terpolymer, or the like, where, at least one other comonomer is polymerized with ethylene or propylene to make the interpolymer.

Suitable unsaturated comonomers useful for polymerizing with ethylene include, for example, ethylenically unsaturated monomers, conjugated or non-conjugated dienes, polyenes, etc. Examples of such comonomers include $C_3$–$C_{20}$ αolefins such as propylene, isobutylene, 1-butene, 1-hexene, 1-pentene, 4-methyl-1-pentene, 1-heptene, 1-octene, 1-nonene, 1 and 1-decene. Preferred comonomers include propylene, 1-butene, 1-pentene, 1-hexene, 4-methyl-1-pentene, 1-heptene and 1-octene, and 1-octene is especially preferred.

Other suitable monomers include styrene, halo- or alkyl-substituted styrenes, vinylbenzocyclobutane, 1,4-hexadiene, 1,7-octadiene, and naphthenics (e.g., cyclopentene, cyclohexene and cyclooctene).

Suitable polypropylene polymers for use in the invention, including random block propylene ethylene polymers, are available from a number of manufacturers, such as, for example, Montell Polyolefins and Exxon Chemical Company. At Exxon, suitable polypropylene polymers are supplied under the designations ESCORENE and ACHIEVE.

Suitable poly lactic acid (PLA) polymers for use in the invention are well known in the literature (e.g., see D. M. Bigg et al., "Effect of Copolymer Ratio on the Crystallinity and Properties of Polylactic Acid Copolymers", *ANTEC* '96, pp. 2028–2039; WO 90/01521; EP 0 515203A; and EP 0 748846A2, the disclosures of each of which are incorporated herein by reference). Suitable poly lactic acid polymers are supplied commercially by Cargill Dow under the designation EcoPLA.

Suitable thermoplastic polyurethane for use in the invention are commercially available from The Dow Chemical Company under the designation PELLATHANE.

Suitable polyolefin carbon monoxide interpolymers can be manufactured using well known high pressure free-radical polymerization methods. However, they may also be manufactured using traditional Ziegler-Natta catalysis and even with the use of so-called homogeneous catalyst systems such as those described and referenced herein above.

Suitable free-radical initiated high pressure carbonyl-containing ethylene polymers such as ethylene acrylic acid interpolymers can be manufactured by any technique known in the art including the methods taught by Thomson and Waples in U.S. Pat. No. 3,520,861, the disclosure of which is incorporate herein by reference.

Suitable ethylene vinyl acetate interpolymers for use in the invention are commercially available from various suppliers, including Exxon Chemical Company and Du Pont Chemical Company.

Suitable ethylene/alkyl acrylate interpolymers are commercially available from various suppliers. Suitable ethylene/acrylic acid interpolymers are commercially available from The Dow Chemical Company under the designation PRIMACOR. Suitable ethylene/methacrylic acid interpolymers are commercially available from Du Pont Chemical Company under the designation NUCREL.

Chlorinated polyethylene (CPE), especially chlorinated substantially linear ethylene polymers, can be prepared by chlorinating polyethylene in accordance with well known techniques. Preferably, chlorinated polyethylene comprises equal to or greater than 30 weight percent chlorine. Suitable chlorinated polyethylenes for use in the invention are commercially supplied by The Dow Chemical Company under the designation TYRIN.

Additives e.g., Irgafos® 168 made by Ciba Geigy Corp.)), may added to thermoplastic polymer or compositions protect against undo degradation during fiber formation and/or thermal processing steps. In-process additives, e.g. calcium stearate, water, etc., may also be used for purposes such as for the deactivation of residual catalyst.

The inventive meltblown layer and the inventive SM structure have utility in a variety of applications. Suitable applications include, for example, but are not limited to, disposable personal hygiene products (e.g. training pants, diapers, absorbent underpants, incontinence products, feminine hygiene items and the like), disposable garments (e.g. industrial apparel, coveralls, head coverings, underpants, pants, shirts, gloves, socks and the like) and infection control/clean room products (e.g. surgical gowns and drapes, face masks, head coverings, surgical caps and hood, shoe coverings, boot slippers, wound dressings, bandages, sterilization wraps, wipers, lab coats, coverall, pants, aprons, jackets, bedding items and sheets).

The following examples are provided to further illustrate and illuminate the present invention but is not intended to limit the invention to the specific embodiments set forth.

EXAMPLES

In evaluation to determine the hydrohead performance of various thermoplastic polymers an ethylene polymer having a low crystallinity, an ethylene polymer having a medium range crystallinity and a polypropylene polymer believed to have an isotacticity index greater than 75 percent were meltblown into fibers (at range of basis weights) at a die temperature of 380° F., 450° F. and 470° F., respectively, and 0.4 grams per die hole per minute (ghm). The meltblown fibers were collected on a take-up drum equipped with a vacuum. The low crystallinity polymer was cooled with a water-spray without the application of the vacuum to minimize excessive sticking. The cooled fibers of from the three thermoplastic polymers were then measured to determine their respective hydrohead performance. Table 1 provides a description of the thermoplastic polymers, the various basis weights and hydrohead test data.

TABLE 1

| Meltblown Sample | Polymer Crystallinity* | Approximate Basis Weight $g/m^2$ | Hydrohead** inches of $H_2O$ (mbar) |
|---|---|---|---|
| A | Low | 30 | 5.45 (13.6) |
| B | Low | 45 | 6.4 (15.9 |
| C | Low | 60 | 5.65 (14.1) |
| D | Low | 75 | 6.3 (15.7) |
| E | Medium | 20 | 7.6 (18.9) |
| F | Medium | 30 | 6.1 (15.2) |
| G | Medium | 30 | 5.2 (12.9) |
| H | Medium | 45 | 7.3 (18.2) |
| I | Medium | 60 | 7.9 (19.7) |
| J | Medium | 70 | 8.0 (19.9) |
| K | High | 10 | 7.1 (17.7) |
| L | High | 20 | 9.3 (23.2) |
| M | High | 30 | 15.0 (37.4) |
| N | High | 45 | 16 (39.8) |
| O | High | 60 | 18.1 (45.1) |

*The polymer employed was a substantially linear ethylene polymer having about a 13.5% DSC crystallinity, a 0.870 g/cc density and a 200 g/10 minute $I_2$ melt index as supplied by The Dow Chemical Company. The polymer employed as the medium crystallinity polymer was a heterogeneously branched ethylene/α-olefin interpolymer having about a 54.5% DSC crystallinity, a 0.93 $g/cm^3$ density and a 150 g/10 minute $I_2$ melt index as supplied by The Dow Chemical Company under the designation ASPUN fiber grade resin 6831A. The polymer employed as the high crystallinity polymer was a polypropylene polymer supplied by Exxon Chemical Company under the designation ESCORENE PP 3546G. A DSC melting curve is provided for the polymer in FIG. 1.

**The hydrohead test was conducted at 1 cm water/second.

In another evaluation, select samples for the above evaluation were subjected to thermal bonding between two smooth-surface rolls at various temperatures, pressures and take-up speeds. Table 2 shows the various secondary processing conditions for the selected samples as well as their resultant hydrohead and water vapor transmission rate performance.

TABLE 2

| Example | Melt-blown Sample | Temperature ° F. | Roll Pressure psig | Roll Speed ft/min | Hydrohead at 0.2 cm $H_2O$/sec in. $H_2O$ (mbar) | Hydrohead at 1 cm $H_2O$/sec in. $H_2O$ (mbar) | Percent Improved Hydrohead (at 1 cm $H_2O$/sec after Secondary Processing |
|---|---|---|---|---|---|---|---|
| Inv. Ex 1 | F | 195 | 2,500 | 40 | 9.4 (23.4) | 8.2 (20.4) | 34.2% |
| Comp. 2 | F | 177 | 2,500 | 63 | 6.9 (17.2) | ND | nil* |
| Comp. 3 | F | None | None | None | ND | 6.1 (15.2) | NA |
| Comp. 4 | D | None | None | None | ND | 6.3 (15.7) | NA |
| Comp. 5 | D | 118 | 1,100 | 20 | 3.2 (8.0) | ND | −55.7%* |
| Comp. 6 | D | 118 | 1,500 | 20 | 3.8 (9.5) | ND | −47.4%* |
| Comp. 7 | A | 118 | 1,500 | 20 | ND | 3.0 (6.8) | −45.0% |
| Comp. 8 | A | None | None | None | ND | 5.45 (13.6) | NA |

TABLE 2-continued

| Example | Melt-blown Sample | Temperature ° F. | Roll Pressure psig | Roll Speed ft/min | Hydrohead at 0.2 cm $H_2O$/sec in. $H_2O$ (mbar) | Hydrohead at 1 cm $H_2O$/sec in. $H_2O$ (mbar) | Percent Improved Hydrohead (at 1 cm $H_2O$/sec after Secondary Processing |
|---|---|---|---|---|---|---|---|
| Inv. Ex 9 | M | 165 | 300 | 63 | 26.8 (66.7) | ND | 47.9%* |
| Inv. Ex 10 | M | 165 | 1,100 | 63 | 31.4 (78.1) | 26.0 (64.7) | 73.3% |
| Comp. 11 | M | None | None | None | ND | 15.0 (37.4) | NA |

*Percentage calculated on basis of 82–87% lower hydrohead value at 1 cm $H_2O$/second versus measurement at 0.2 cm $H_2O$/second.

The data in Table 2 indicate that separate secondary processing of meltblown fibrous layers comprised of a semicrystalline thermoplastic polymer unexpectedly results in substantially improved hydrohead performance. See Inventive Examples 1, 9 and 10. Table 2 also indicates that where the thermoplastic polymer was substantially amorphous rather than semicrystalline, separate secondary processing of meltblown layers results in a reduction in hydrohead performance. See comparative examples 5, 6 and 7.

Table 3 which shows the water vapor transmission rates for various examples indicates that meltblown layers comprised of a semicrystalline thermoplastic polymer maintain excellent breathability after separate secondary processing.

TABLE 3

| Example | Water Vapor Transmission Rate $g/m^2/day$ | Percent Retained WVTR |
|---|---|---|
| Inv. Ex 1 | 4,166 | 89% |
| Comp. 2 | 4,411 | 94% |
| Comp. 3 | 4,687 | NA |
| Comp. 4 | 4,687 | NA |
| Comp. 6 | 3,947 | 84% |
| Comp. 7 | 4,687 | NA |
| Comp. 8 | ND | NA |
| Inv. Ex 9 | 4,411 | 94% |
| Inv. Ex 10 | 4,288 | 91% |
| Comp. 11 | 4,687 | NA |

We claim:

1. A method of making an improved meltblown fibrous layer characterized as having:

(a) a hydrohead performance at least 16.5 percent greater than the hydrohead of a first meltblown layer, (b) a basis weight less than 67 $g/m^2$ and equal to or less than the basis weight of the first meltblown layer, and (c) a water or moisture vapor transmission rate within at least 88 percent of the first meltblown layer, the method comprising (i) providing the first meltblown layer, (ii) separately secondarily processing the first meltblown layer at an elevated temperature, an elevated pressure and a residence time which equates to a roll speed of less than 20 feet/minute (6.1 m/min.) to effectuate the improvement, and (iii) collecting the improved meltblown layer.

2. The method of claim 1 wherein the meltblown layer comprises an elastic material or has an elastic material incorporated therein.

3. The method of claim 2 wherein the elastic material is an ethylene polymer.

4. The method of claim 2 wherein the elastic material is incorporated into the meltblown layer by a conjugated meltblowing technique, direct lamination or fiber interlayment during or following the secondary processing step.

5. The method of claim 4 wherein the elastic material is incorporated by a conjugated technique in a side by side configuration.

6. The method of claim 1 wherein the separate secondary processing step is be accomplished by a technique selected from the group consisting of thermal bonding, thermal point bonding, ultra-sonic bonding and through-air bonding.

7. The method of claim 1 wherein the separate secondary processing step is accomplished by employing a nip roll, calender roll or roll stack.

8. The method of claim 5 wherein the separate second processing step comprises thermally bonding the first meltblown layer between at least two non-embossed nonstick calender rolls wherein the surfaces minimize adhesion or sticking of the meltblown layer during the step.

9. The method of claim 1 wherein the inventive meltblown layer comprises a thermoplastic polymer or composition.

10. The method of claim 9 wherein the thermoplastic polymer or composition is an ethylene polymer, polycarbonate, styrene polymer, polypropylene, thermoplastic polyurethane, polyamide, polylactic acid interpolymer, thermoplastic block polymer, polyether block copolymer, copolyester polymer, polyester/polyether block polymers or, polyethylene terephthalate (PET).

11. The method of claim 9 wherein the thermoplastic polymer or composition is characterized as having a crystallinity of greater than or equal to 50 percent.

12. The method of claim 1 wherein the meltblown layer comprises an is ethylene polymer or polypropylene.

13. The method of claim 12 wherein the ethylene polymer or polypropylene is manufactured using a metallocene-catalysis.

14. The method of claim 12 wherein the polypropylene has a melt flow rate (MFR) between about 300 and about 3,000 g/10 minutes, as measured in accordance with ASTM D-1238, Condition 230° C./2.16 kg.

15. The method of claim 12 wherein the polypropylene has an isotacticity index greater than or equal to 80 percent.

16. The method of claim 12 wherein the ethylene polymer has an $I_2$ melt index between about 60 and about 300 g/10 minutes, as measured in accordance with ASTM D-1238, Condition 190° C./2.16 kg.

17. The method of claim 12 wherein the ethylene polymer has a crystallinity greater than or equal to 60 percent by weight, as determined using differential scanning calorimetry (DSC).

* * * * *